United States Patent [19]

Wallman

[11] 3,977,062

[45] Aug. 31, 1976

[54] METHOD OF ASSEMBLING BLOWER ROTORS

[76] Inventor: Knut Olof Lennart Wallman, Fergas AB Harstenagatan 2, S-582 21 Linkoping, Sweden

[22] Filed: Jan. 22, 1975

[21] Appl. No.: 542,915

[52] U.S. Cl. ..... 29/156.8 CF; 29/200 B; 29/208 F; 29/211 R; 29/33 K; 416/187

[51] Int. Cl.[2] ..... B23P 15/00; B23P 11/00; B23P 19/04

[58] Field of Search ..... 29/156.8 CF, 208 R, 29/208 F, 211 R, 200 R, 429, 23.5, 33 K, 200 B; 416/178, 184, 187

[56] References Cited

UNITED STATES PATENTS

| | | | |
|---|---|---|---|
| 2,895,666 | 7/1959 | Girdwood et al. | 416/184 |
| 3,262,637 | 7/1966 | Sprouse et al. | 29/156.8 CF |
| 3,385,511 | 5/1968 | Wentling | 29/156.8 CF |
| 3,522,645 | 8/1970 | Kennicott | 29/208 R |
| 3,641,644 | 2/1972 | Conniff et al. | 29/156.8 CF |
| 3,668,773 | 6/1972 | Achterberg | 29/156.8 FC |

*Primary Examiner*—C.W. Lanham
*Assistant Examiner*—Dan C. Crane

[57] ABSTRACT

A machine for assembling blower rotors comprises a fixture with a cylindrical interior surface in which there are shallow, axially spaced, radially inwardly opening circumferential grooves. The grooves receive marginal portions of flat sheet metal discs that have blade slots opening to their peripheries, thus holding the discs in spaced, coaxial relationship and allowing them to be indexingly rotated, ratchet-fashion, by pawls that engage circumferentially facing edges on the discs. Indexing rotation brings a slot in each disc into alignment with a blade guiding surface on the fixture, and a pusher moving along that surface forces individual blades edgewise along it and into the discs.

4 Claims, 8 Drawing Figures

Fig. 1
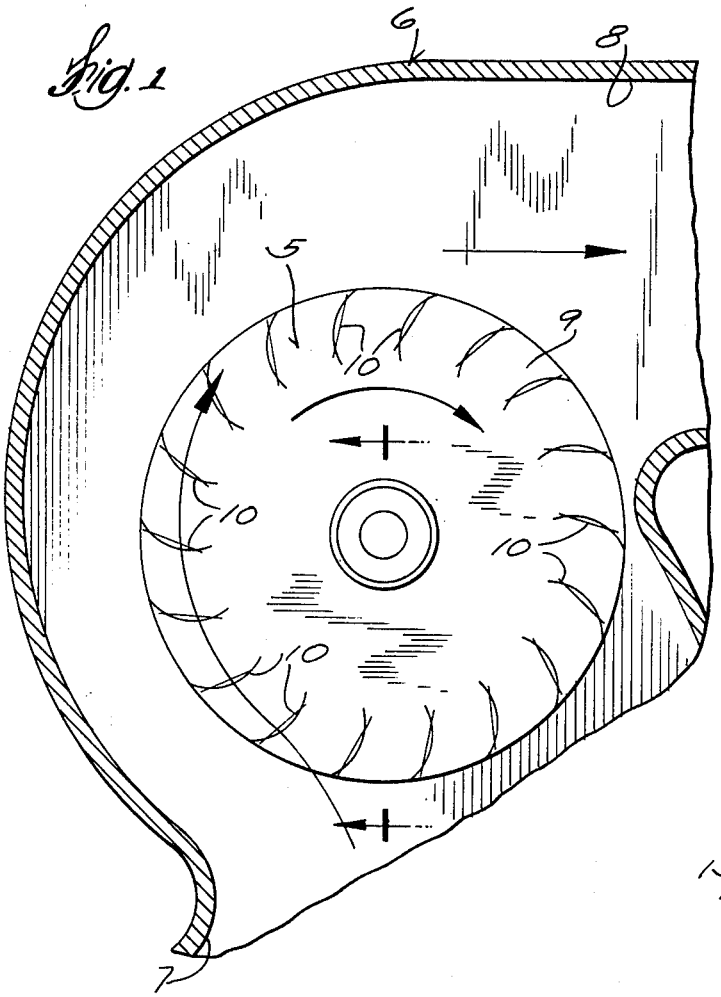
Fig. 3
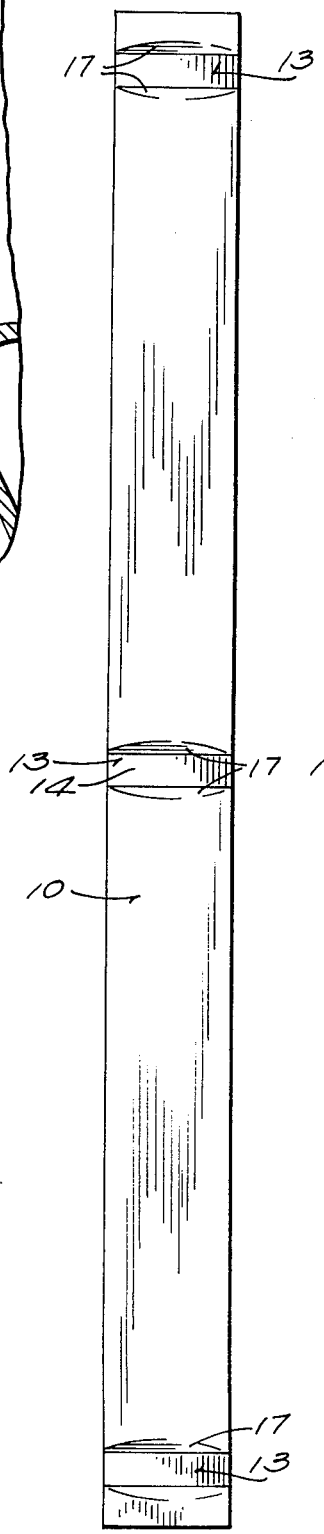
Fig. 4
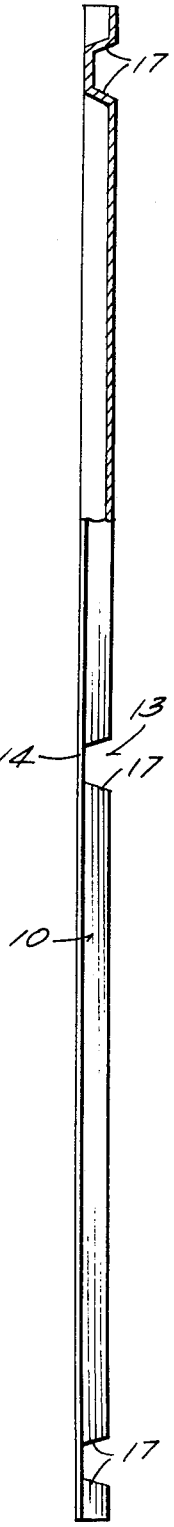
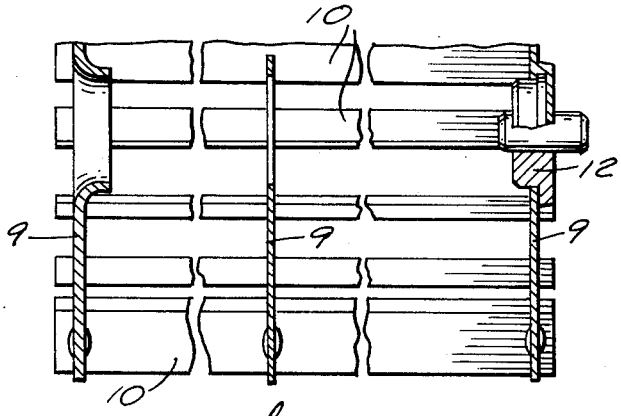
Fig. 2

TO VALVES
TIMING APPARATUS

METHOD OF ASSEMBLING BLOWER ROTORS

This invention relates to a machine for assembling the rotors of cross-flow blower fans, and the invention is more particularly concerned with a machine by which a plurality of discs can be coaxially held in axially spaced relation to one another and can be indexingly rotated in unison for insertion of elongated blades into circumferentially spaced slots in the discs that open to their peripheries.

The machine to which the present invention relates is particularly intended for the assembly of blower rotors having certain features that are disclosed in my copending application, Ser. No. 502,097 filed Aug. 30, 1974, which is a continuation-in-part of my abandoned application Ser. No. 347,340, filed Apr. 2, 1973.

In general, a rotor for a cross-flow blower comprises two or more sheet metal discs of circular outline that are in spaced coaxial relation with one another, and a plurality of long, narrow blades of curved cross-section that are secured to peripheral portions of the discs at circumferentially equispaced locations around them. In the finished rotor the blades hold the discs in parallel, spaced relation to one another and the discs hold the blades in circumferentially spaced relationship and with their longitudinal edges parallel to the coinciding axes of the discs. It will be understood that the connections between the discs and the blades must be very secure and rigid for this relationship to be maintained throughout the life of the rotor. The above mentioned copending application discloses a rotor in which the joints between the blades and the discs are particularly advantageous in this respect.

Each of the discs of the rotor disclosed in said application has blade receiving slots which open to its periphery. The edges of the slots are of such configuration relative to the portions of the blades that are received in them that the blades are insertable into the slots with an edgewise substantially translatory motion. After blades have been inserted into all of the slots in the discs, peripheral portions of each disc are edgewise deformed to close the mouths of the slots. Preferably the blades fit the slots rather snugly, by reason of a relationship between the blades and the slot edges which is particularly disclosed in said application. Hence the discs and blades can be assembled with one another at one location, and edgewise deformation of the disc peripheries can be accomplished at another location, without danger of the rotor coming apart in transit between those locations.

It will be apparent that the assembly of such a rotor presents a problem, in that the blades cannot be inserted into the slots in the discs unless the discs are held in properly spaced coaxial relationship to one another, whereas — absent some suitable fixture — the discs are not maintained in that relationship until a substantial number of blades have been assembled with them.

A general object of the present invention is to provide a machine which affords a solution to this problem by way of a fixture in which the discs are held while blades are inserted into their slots, and wherein the discs can be indexingly rotated in unison to bring circumferentially successive slots successively to a position at which blades can be automatically inserted into them.

Another and very important object of the invention is to provide a machine of the character described that incorporates means for effecting indexing rotation of the discs alternately with automatic insertion of blades into the disc slots.

A further and more specific object of the invention is to provide a machine of the character described wherein very accurate indexing rotation of the discs is effected by means of apparatus which is very simple in character but which is nevertheless readily adjustable to provide for the assembly of rotors having various numbers of circumferentially equispaced blades.

In particular, it is an object of this invention to provide a rotor assembling machine by which the discs are held in coaxial spaced apart relation in such a manner that they can be incrementally rotated by means of a reciprocating indexing device which makes opposite indexing and return strokes and which has a readily adjustable stroke length, and wherein the indexing device comprises a pawl-like member that drivingly engages each disc during the indexing stroke and automatically maintains itself out of driving engagement with the discs during the return stroke.

In connection with the last-stated object of the invention it is another object of this invention to provide a machine which is capable of automatically assembling rotors comprising more than two discs — i.e., rotors of relatively great axial length having one or more discs intermediate their ends to afford support to medial portions of the blades — and wherein all of the discs of such a rotor assembly are indexingly rotated in unison for insertion of blades into their slots.

Considered more broadly, it is an object of the invention to provide a method and machine for assembling a blower rotor comprising elongated blades and a disc having blade receiving slots opening to its periphery, wherein the disc may be adjacent to an end of the blades or may be intermediate their ends, the assembly being accomplished with equal facility in either case.

Heretofore certain machines that have been available for the assembly of blower rotors have required the discs to have holes spaced from their axes to provide for connection to the discs of drive means by which the discs were indexingly rotated during the assembly operation. However, there are blower installations in which leakage through the discs is unacceptable, and obviously the rotors intended for those installations could not be assembled with the use of such prior machines.

It is thus a further object of the present invention to provide a machine for assembling blower rotors which does not require the rotor discs to have any holes that are not needed for the purpose of the installation for which the rotor is intended.

It is also a special object of this invention, realized in certain embodiments thereof, to provide a rotor assembling machine which comprises fixed and movable die members by which a new blade is formed from sheet metal stock each time a previously formed blade is assembled with discs, and wherein the same press mechanism that carries the movable die member can also serve to effect insertion of blades into the disc slots and to effect indexing rotation of the discs.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate two complete examples of embodiments of the invention constructed according to the best modes so far devised for the practical application of the principles thereof, and in which:

FIG. 1 is an end view of a rotor assembled by means of a machine embodying the principles of this invention, shown in position in the housing of a cross-flow blower installation;

FIG. 2 is a longitudinal sectional view taken on the line 2—2 in FIG. 1; FIGS. 3 and 4 illustrate one form of blade suitable for assembly into rotors by means of the machine of this invention, showing the blade in plan and view, respectively;

Figure 5:
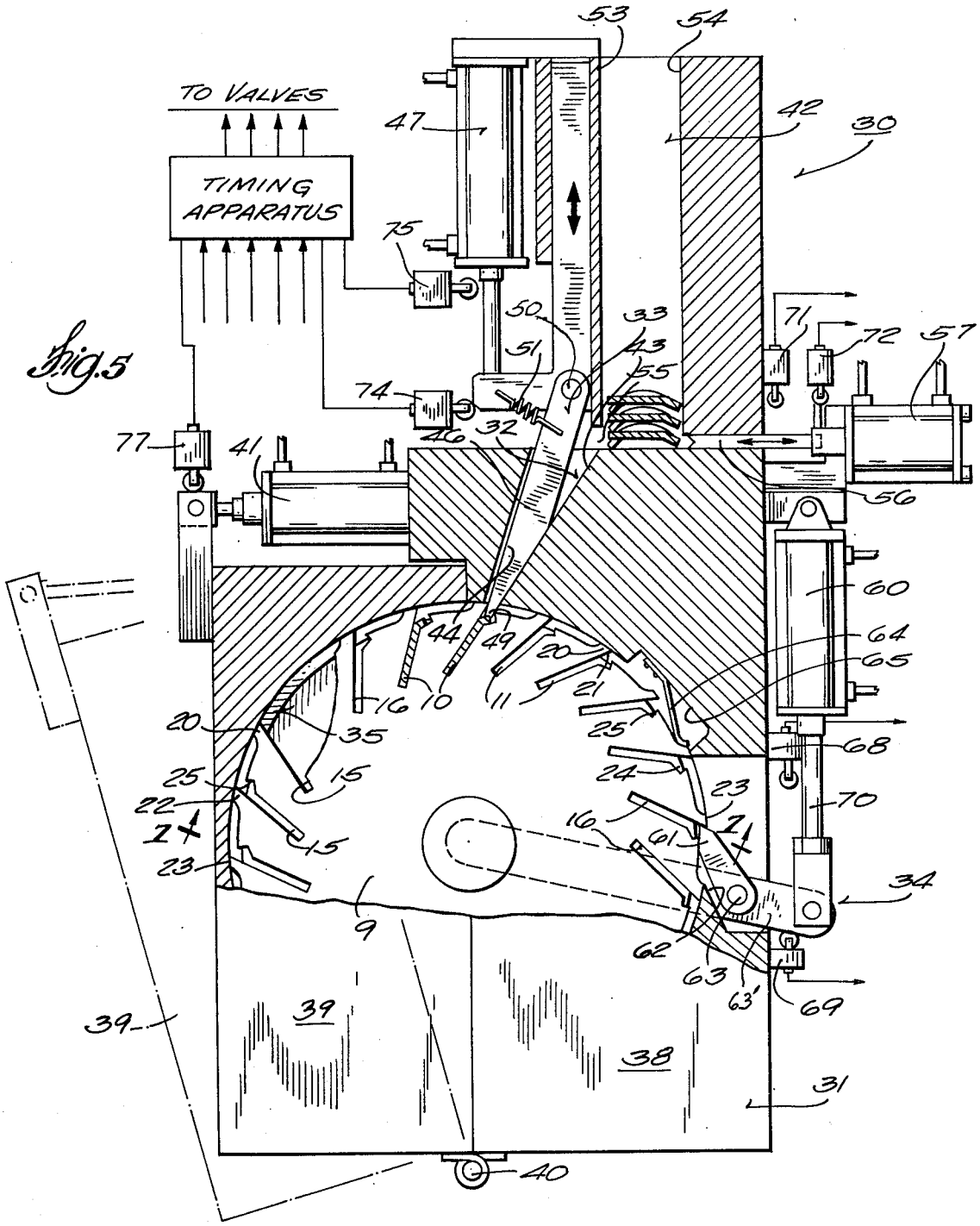
FIG. 5 is a view in vertical section of a rotor assembling machine embodying the principles of this invention.
Figure 7:
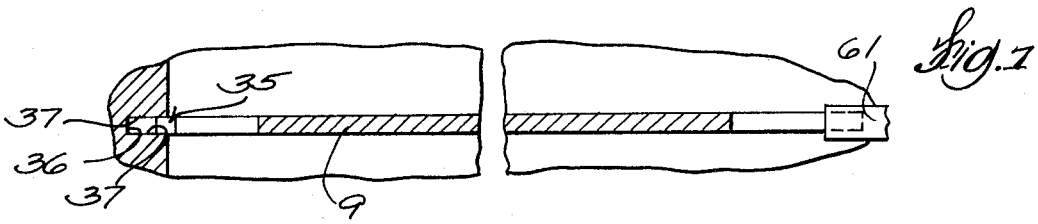
FIG. 7 is a sectional view taken on the plane of the line 7—7 in FIG. 5.

Referring now to the accompanying drawings, the numeral 5 generally designates an impeller or rotor which can be assembled by means of a machine of this invention and which is intended for use in a cross-flow fan or blower, the rotor being mounted in the casing 6 of the blower as shown in FIG. 1. The casing may have a radially oriented inlet 7 near one side and a radially oriented outlet 8, the axis of the outlet being at about 90° to that of the inlet in the direction of rotor rotation. The rotor rotates clockwise as shown in FIG. 1 to draw air into the inlet 7 and force it out of the outlet 8.

As is customary, the rotor 5 comprises a number of flat, circular discs 9 that are held in spaced coaxial relationship with one another by their connections with a number of identical elongated blades 10, and the blades, in turn, are maintained by the discs in circumferentially equispaced relation to one another and lengthwise parallel to the rotor axis. The blades are fixed in slots 11 in each disc that open to its periphery, all such slots being oriented at identical oblique inclinations to radials through their mouths from the rotor axis.

The several discs 9 can be stamped from sheet metal to be identical with one another, but the two discs that are at the opposite axial ends of the rotor can be provided with suitable hubs or coupling members 12 which define the axis about which the rotor rotates and which provide for journaling the rotor and for rotatably driving it.

Each of the blades 10 comprises a sheet metal stamping having an arcuately curved cross-section. The curvature of the cross-section profile is uniform along most of the length of the blade, but preferably the blade has a transverse crease-like indentation 13 at each of the lengthwise spaced zones where the blade is secured to a rotor disc. Each such indentation defines a channel-shaped portion on the blade, with the back of each channel providing a narrow strip 14 that is receivable between opposite slot-defining edges 15 and 16 of a disc. The strip 14 is of course elongated in the direction transverse to the length of the blade, and it has a curvature along its length which is substantially less than the curvature of the cross-section profile of the uncreased portions of the blade. The portions 17 of the blade that flank the strip 14 along its opposite longitudinal edges, and which define the flanges of the channel-shaped indentation, provide abutments which engage opposite faces of a disc when the strip 14 is received in a slot therein, and they thus confine the blade against lengthwise displacement relative to the disc.

In a blower rotor to be assembled by the method and machine of this invention, there is a geometrical relationship between each blade slot 11 in the disc and the portion 14 of the blade that is received therein, which relationship is such that the blade is receivable in the slot with an edgewise substantially translatory motion, and as a preferred additional feature, that a certain amount of edgewise force must be exerted upon the blade to effect at least the final stages of its insertion. Insertion of the blade with such a translatory motion can of course be accomplished more easily than when the blade is required to move into the slot with a combination of edgewise and rotary motion, especially if some force must be exerted upon the blade to install it in the slot; and if such edgewise force must be exerted during insertion of the blade, the inserted blade will resist displacement out of the slot.

To provide for edgewise translatory blade insertion, the opposite edges 15 and 16 which define each slot 11 in a disc can be straight, or only slightly curved, along most of their lengths, and can be spaced apart by a uniform distance along most of their lengths. Preferably, too, the mouth of the slot is at least as wide as the narrowest part of the slot that is inwardly thereof.

To enable the blade to resist displacement out of the slot, the profile of each strip 14, as considered along the length of the strip (i.e., across the width of the blade), can have a curvature which is, at most only slightly different from that of the parallel slot edges 15 and 16 between which it is received. Furthermore, as explained in more detail in the above mentioned copending application, the thickness and the said profile of the strip 14 are preferably in such relation to the spacing and configuration of the opposing slot edges 15 and 16 that when the strip is fully received in the slot, the strip is held under a certain amount of flexing deformation along its length so that it reacts against each of the slot edges 15 and 16 to be engaged against the opposite slot edge under friction producing bias.

After all of the blades and discs that comprises a rotor have been preliminarily assembled with one another by means of a machine of this invention, as described hereinafter, peripheral portions of each disc are edgewise deformed to close the mouths of the slots and thus establish permanent connections between the blades and the discs. The above mentioned copending application discloses various configurations that the undeformed disc can have in order for its periphery to be uninterruptedly circular after the deforming operation has been accomplished. In the present case only one such disc configuration is illustrated by way of example, but it is to be understood that the disc could have any other configuration that meets certain requirements set forth below. As here shown, the disc as initially formed has tabs 20 that project radially from its periphery, one adjacent to the mouth of each slot 11, and each such tab has a circumferentially facing edge portion 21 that can be straight and continuous with one edge 16 of its adjacent slot. Note that said edge portions 21 of the several tabs all face in the same circumferential direction, and that each tab has a nose 22 defined by its said circumferentially facing edge portion 21 and by a radially outer edge portion 23 on the tab.

Near the mouth of each slot its edge 15 that is opposite the tab 20 defines a bay 24 which opens generally towards the tab. This bay is in part defined by an edge portion 25 that extends inwardly from the periphery of the disc and faces obliquely into the slot. When the tab 20 is edgewise deformed to close the mouth of the slot, its nose 22 is received in the bay 24 and is locked against radially outward displacement by the edge portion 25.

In the particular rotor here shown for purpose of illustration, the crease or indentation 13 does not extend entirely across each blade but instead terminates a distance short of the edge of the blade which is to be radially outermost in the assembled rotor. Hence the strip 14 has a portion 26 which is curved in profile and which extends along the slot edge 15 and into the bay 24, and edgewise deformation of the tab 20 brings the tab to a position which it is engaged against this curved portion of the strip along the length thereof.

As more particularly explained in the above mentioned copending application, the tabs can be edgewise deformed by a rolling operation that can be accomplished after the blades are assembled into the discs. Preferably that rolling operation is performed elsewhere than in the machine of this invention, but if the blades have the preferred snug fit in the disc slots, the preliminarily assembled rotor can be removed from the assembling machine and transported to the rolling station without any danger that the rotor will be deformed or that parts of the assembly will be displaced during the course of reasonably careful handling.

The edgewise deformation of the tabs can be accomplished by means of a roller 95 that compresses them as the disc is rotated about its axis relative to the roller. The roller has a circumferentially grooved periphery to confine the tabs to edgewise deformation. If the rolling operation is so performed as to somewhat reduce the disc diameter, it forms a bead 96 around the disc periphery. Inasmuch as formation of the bead involves edgewise displacement of metal at the slot mouths, the bead tends to lock the edgewise deformed tabs into place; or, in the absence of the tabs, the reduction of the width of the slot mouths that results from formation of the bead might be relied upon to confine the blades in the slots.

Turning now to a consideration of the assembling machine itself, which is designated generally by 30, it comprises, in general, a fixture 31 into which discs are inserted and by which they are held in the desired spaced, coaxial relationship. The machine further comprises a blade guide 32 by which blades are guided for edgewise insertion into aligned slots 11 in the discs, a blade pusher mechanism 33 by which edgewise force is exerted on blades to drive them into the disc slots, and an indexing mechansim 34 by which the several discs in the fixture are rotated in unison to bring their circumferentially successive slots 11 successively into alignment with the blade guide, for blade insertion.

The fixture 31 defines a receptacle having a cylindrical interior surface with an inside diameter equal to the outside diameter of the finished rotor to be assembled in it. At axially spaced intervals in the interior of the fixture there are radially inwardly opening circumferential grooves 35, each of which serves as a track or guide in which a disc is to be confined for rotation about its axis. There is of course one groove 35 for each disc in the assembled rotor, and the several grooves are axially spaced from one another in correspondence with the spacing intended for the disc of the rotor.

The bottom surfaces 36 of the several grooves are curved concentrically on a radius equal to the outside radius of an undeformed disc, so that bottom surface portions of each groove engage circumferentially spaced peripheral edge portions of a disc to guide the disc for rotation about its axis and hold it coaxial with the other discs.

Each groove is relatively shallow, which is to say that its axially oppositely facing side surfaces 37 are of small radial extent, and therefore only marginal portions of the disc, directly adjacent to its periphery, are confined between these side surfaces so that they cooperate to hold the disc parallel to other discs in the fixture. Specifically, the depth of each groove 35 is such that the tabs 20 of a disc and a very small marginal edge portion of the circular disc periphery are within the grooves. Inasmuch as the radius of the bottom surface 36 of the groove is controlled by the overall radius of the disc, the depth of the groove is controlled by the radius of the interior cylindrical surface of the ungrooved portions of the fixture, and the latter radius, in turn, is controlled by the overall radius of the assembled rotor as measured to the radially outer edges of its blades. In this connection it is to be observed that the slots 11 are of such depth that when the blades are fully inserted into them the radially outer edge of each blade lies a little inside the outside radius of the disc periphery.

It will now be apparent that the machine of this invention can be employed to assemble rotors having any of various kinds of discs, so long as those discs have certain characteristics. The disc must have slots in which the blades are received, each of which slots opens to the periphery of the disc and is straight along its length, or so nearly straight as to permit a blade to be inserted into it with an edgewise substantially translatory motion. The mouth of the slot should not be constricted, which is to say that the mouth of each slot should be at least as wide as the narrowest part of the slot inwardly of it. The slots should be spaced from one another at uniform circumferential intervals, and adjacent to the mouth of each slot the disc should have an edge portion that faces generally in one circumferential direction, to provide for indexing of the disc, as explained hereinafter. Finally, the depth of each slot, as mentioned above, should be such that when a blade is fully inserted into it, the radially outer edge of the blade is spaced radially inwardly of the disc periphery by a small amount. It is preferred that the blades be received in the slots with a snug fit, but it is not essential that they do so.

To enable discs to be inserted into the fixture, and to allow rotor assemblies to be removed from it, the fixture comprises complementary stationary and movable members 38 and 39 respectively, divided from one another on a diametral plane that lies on the axis of the cylindrical interior surface of the fixture. The movable member 39 can have a hinge connection 40 to the stationary member 38, to swing about an axis at the bottom of the fixture. To provide for automatic operation of the machine, a double acting hydraulic or pneumatic cylinder 41 can be connected between the two fixture members, at one end of the fixture, whereby the movable member can be actuated to its open position, illustrated in broken lines in FIG. 5, and to its closed or operative position, in which it is shown in solid lines.

On top of the stationary fixture member there is a blade magazine 42 for holding a supply of blades that are to be inserted into discs in the fixture; and from the bottom of the magazine a blade guiding surface 43 extends obliquely downwardly into the interior of the fixture. As measured in the direction of the axis of the cylindrical interior of the fixture, the blade guiding surface 43 has a length equal to the length of a blade, and it terminates, at its axially opposite ends, at opposing upright surfaces which engage the ends of a blade sliding edgewise along it, to dispose the blade in the correct axial relationship to discs in the fixture.

A surface 44 on the stationary fixture member, opposing the blade guiding surface 43, cooperates with the latter in defining a downwardly tapering blade inserting inlet to the interior of the fixture. At its lower end the surface 44 is spaced from the blade guiding surface 43 by a distance equal to the projected height of a blade. The obliquely downward inclination of the blade guiding surface 43 is such that when a slot 11 in a disc is in register with the inlet conjointly defined by said surfaces 43 and 44, the blade guiding surface 43 aligns with the edge 15 of the disc slot.

A blade inserting pusher 46 is reciprocated up and down in the blade inserting inlet, for forcefully driving blades downwardly into disc slots 11 that are aligned with the blade guiding surface 43. The pusher 46 is driven for such reciprocation by means of a blade inserting actuator 47 which can be mounted on top of the stationary fixture member and which can comprise another double-acting hydraulic or pneumatic cylinder mechanism. The lower end of the pusher 46 is so formed, as indicated at 49, that it can have driving engagement with the rear edge of a blade moving edgewise down the blade guiding surface 43. It will be understood that the pusher 46 could comprise pairs of tongue-like elements, the elements of each pair being spaced apart by a distance about equal to the thickness of a disc, and the two elements of each pair being engageable with the rear edge of a blade at locations closely adjacent to opposite faces of a disc, all of said elements being constrained to move in unison.

The magazine 42 is arranged to hold a stack of blades in flatwise superimposed relationship with their concave surfaces lowermost. It comprises opposing front and rear walls 53 and 54 that project up from the top of the stationary fixture member and are spaced apart by a distance substantially equal to the width of a blade. The front wall 53 is spaced above the bottom of the magazine by a distance substantially equal to the projected height of a blade, defining an outlet slot 55 through which the bottom blade of a stack in the magazine can move edgewise onto the inclined blade guiding surface 43 to slide down along the latter.

A horizontally reciprocating plunger-like blade feeder 56 moves into and out of the bottom portion of the magazine through a slot in its rear wall 54. The blade feeder is driven by an actuator 57 which, again, can comprise a double acting hydraulic or pneumatic cylinder mechanism. In a feed stroke of the actuator 57 the feeder moves into the magazine to drive the lowermost blade of a stack therein forwardly out through the slot 55. In its return stroke the feeder moves out from under the stack of blades in the magazine, permitting the whole stack to drop through a distance equal to the projected height of one blade and bringing a new blade into position to be advanced onto the blade guiding surface.

The blade feeder is of course synchronized with the blade inserting pusher 46, as explained hereinafter, so that a new blade is fed onto the blade guiding surface 43 when the blade inserting pusher is in a raised position, clear of the blade guiding surface. In turn, the blade inserting pusher and the blade feeder are further synchronized with the indexing mechanism 34, as is explained hereinafter, so that a blade moves down the blade guiding surface only when discs in the fixture have been brought to positions at which unfilled slots in them are aligned with the blade guiding surface.

The indexing mechanism 34 effects step-wise or indexing rotation of the several discs by engaging the circumferentially facing edge portion of a tab 20 on each disc to push that edge portion circumferentially through a predetermined distance. The indexing mechanism could comprises an intermittently rotating device, in the nature of a star-wheel or the like, but preferably it comprises, as shown, a reciprocating actuator 60 which moves in opposite indexing and return strokes and which, like the other actuators, can comprise a double-acting hydraulic or pneumatic cylinder mechanism. The indexing actuator is located alongside the stationary fixture member 38, at the opposite side of it from the movable fixture member 39, and has its axis oriented vertically. Connected with the indexing actuator are a plurality of pawls 61, one for each side. The pawls 61 project into the interior of the fixture through circumferentially extending slots 62 in the stationary fixture member that open through the latter from the disc holding grooves 35.

The connection between each pawl and the indexing actuator 60 comprises an arm 63' that swings about the fixture axis and to the outer end of which the actuator is connected, and a pivot connection 63 between that arm and the pawl. The pawl is thus carried bodily in indexing and return strokes with the actuator but has its disc-engaging end portion movable relative to the actuator in directions generally toward and from the axis of the fixture. By means of gravity, or by a suitable spring (not shown), each pawl is biased towards the fixture axis so that it tends to remain engaged with its disc. During the indexing stroke of the actuator 60 the pawl engages the circumferentially facing edge portion 21 of a tab 20 on the disc to impart indexing rotation to the disc. As the actuator 60 makes its return stroke, the pawl is cammed outwardly by the disc to ride around its peripheral edge.

To prevent the indexing mechanism from frictionally imparting retrograde rotation to the discs, and to prevent rotational inertia from carrying the discs beyond the positions established by the indexing mechanism, the fixture can be equipped with at least one suitable spring finger 64 for each disc, bearing against the disc to frictionally retard its rotation. As shown, the spring finger 64 has its captive end in a recess 65 that forms a sort of bay in the disc receiving groove in the stationary fixture member, and the free end portion of the spring finger bears against the peripheral edge of the disc.

It will be apparent that in the absence of tabs 20 on the disc, the pawls 61 can engage slot edges just inside the mouths of the slots, in view of the fact that the depth of each slot is somewhat greater than the width of its blade. Obviously, however, the tabs 20 provide circumferentially facing edges that ensure a more reliable driving connection between each disc and the indexing mechanism, in addition to providing metal for closing the slot mouths, as explained above.

As shown, the limits of the indexing and return strokes of the actuator 60 can be adjustably controlled by means of limit switches 68, 69 that are actuated by suitable abutment means moving with the actuator. The switches 68 and 69 are so mounted on the stationary fixture member 38 as to be adjustable through limited distances in directions lengthwise of the path of the piston rod. The switch 68, which is actuated to terminate the indexing stroke, is so positioned that indexing rotation of each disc stops when a slot 11 in the disc is exactly aligned with the blade guiding surface 43. The switch 69, which is actuated to terminate the return stroke, can then be adjusted to ensure that the pawl will be carried around the disc from one tab 20 to the circumferentially adjacent one. It will be apparent that if the switch 68 is correctly adjusted, the switch 69 can be adjusted to permit a substantial amount of overtravel of the actuator without compromising indexing accuracy.

The limits of movement of the blade feeding actuator 57 are governed by limit switches 71 and 72, which generally correspond to the arrangement and functioning of the limit switches 68 and 69. In like manner, the limits of motion of the blade inserting actuator 47 are controlled by limit switches 74 and 75; and the limit of closing motion of the movable fixture member 39 is controlled by a limit switch 77 operatively associated with the acutator 41. It will be understood that, instead of switches, the several limit control devices 68–69, 71–72, 74–75 and 77 could comprise valves, or any of various types of position sensors.

The several actuators are synchronized by means of timing apparatus connected with the several limit switches 68–69, 71–72, 74–75 and 77. The timing apparatus can take any of a number of different forms, all of which will be readily apparent from a description of its function, and therefore it is not shown in detail in the drawings.

At the beginning of a rotor assembling operation, the movable fixture member 39 is in its open position, to enable an operator to load the necessary number of discs into their receiving grooves 35 in the stationary fixture member. This done, the operator manually starts the timing apparatus. As a first operation the actuator 41 swings the movable fixture member to its closed position, in which the discs are rotatably confined in the interior of the fixture.

When the movable fixture member reaches its fully closed position, the limit switch 77 is actuated, terminating movement of the actuator 41 in the closing direction and issuing to the timing mechanism a signal which causes operation of the indexing actuator 60 to be initiated. The indexing actuator moves through an indexing stroke to bring a slot 11 in each disc into alignment with the blade guiding surface 43. Note that the pawl-and-ratchet indexing drive of the discs permits the discs to be loaded into the fixture in random rotational positions, and if their circumferentially facing tab surfaces 21 are facing in the proper direction for engagement by the pawls 61, the first indexing stroke will automatically bring all of the discs into proper rotational positions for a blade insertion.

When the indexing actuator 60 reaches the end of its indexing stroke, actuation of the limit switch 68 causes a signal to be issued which terminates that indexing stroke and substantially simultaneously effects initiation of a return stroke of the indexing actuator. The return stroke is terminated upon actuation of the limit switch 69. Upon the actuation of limit switch 69 — or, if desired, promptly upon actuation of switch 68, or shortly thereafter — the blade feeding actuator 57 is caused to move in its feeding stroke. At this time the blade inserting pusher 46 is in its elevated or retracted position, in which it is spaced above the blade guiding surface 43 so that the blade thrust out of the magazine 42 by the blade feeder 56 can slide down the blade guiding surface 43 and under the pusher 46.

When the blade feeder actuator 57 reaches the end of its feeding stroke, it actuates limit switch 71, which issues a signal that causes a return stroke of that actuator to be initiated. The return stroke is of course terminated by actuation of limit switch 72.

The initiation of the blade inserting stroke of the blade pusher actuator 47 is so timed in relation to the operation of the blade feeder 56 that a blade just discharged from the magazine is at the mouths of slots in the discs when the pusher 46 begins its downward stroke. Thus an inserting stroke of actuator 47 can begin either upon actuation of limit switch 72 or after a predetermined delay following actuation of limit switch 71. As the blade inserting pusher 46 is carried downwardly, its lower end engages the rear edge of the blade, and the continued downward movement of that pusher forces the blade all the way into the disc slots.

When the blade inserting pusher has reached the limit of its blade inserting stroke, the limit switch 74 is actuated to terminate that stroke and initiate a return stroke. At this point it may be observed that the connection 50 between the pusher 46 and its actuator is one that allows the lower end of the pusher to swing between the blade guiding surface 43 and the opposing surface 44. A spring 51, reacting between the pusher and its actuator, biases the pusher away from the blade guiding surface so that during the latter portion of the return stroke of the pusher a blade sliding along the surface 43 can pass beneath it. During the inserting stroke, the surface 44 swings the pusher in the direction to bring its lower blade engaging end back over to the blade guiding surface.

Actuation of the limit switch 75 terminates the return stroke of the blade inserting pusher and also effects initiation of a new indexing stroke of the indexing actuator 60. It will be understood that the cycle of indexing, blade feeding and blade insertion is then repeated until blades have been inserted into all of the disc slots. The timing apparatus can include a counter which controls the number of such cycles that occur, in correspondence with the number of slots 11 in a disc. At the conclusion of that number of cycles, the timing apparatus causes the actuator 41 to swing the movable fixture member 39 to its open position so that an operator can remove the assembled rotor from the fixture and load the fixture with discs for a new rotor.

Figure 6:
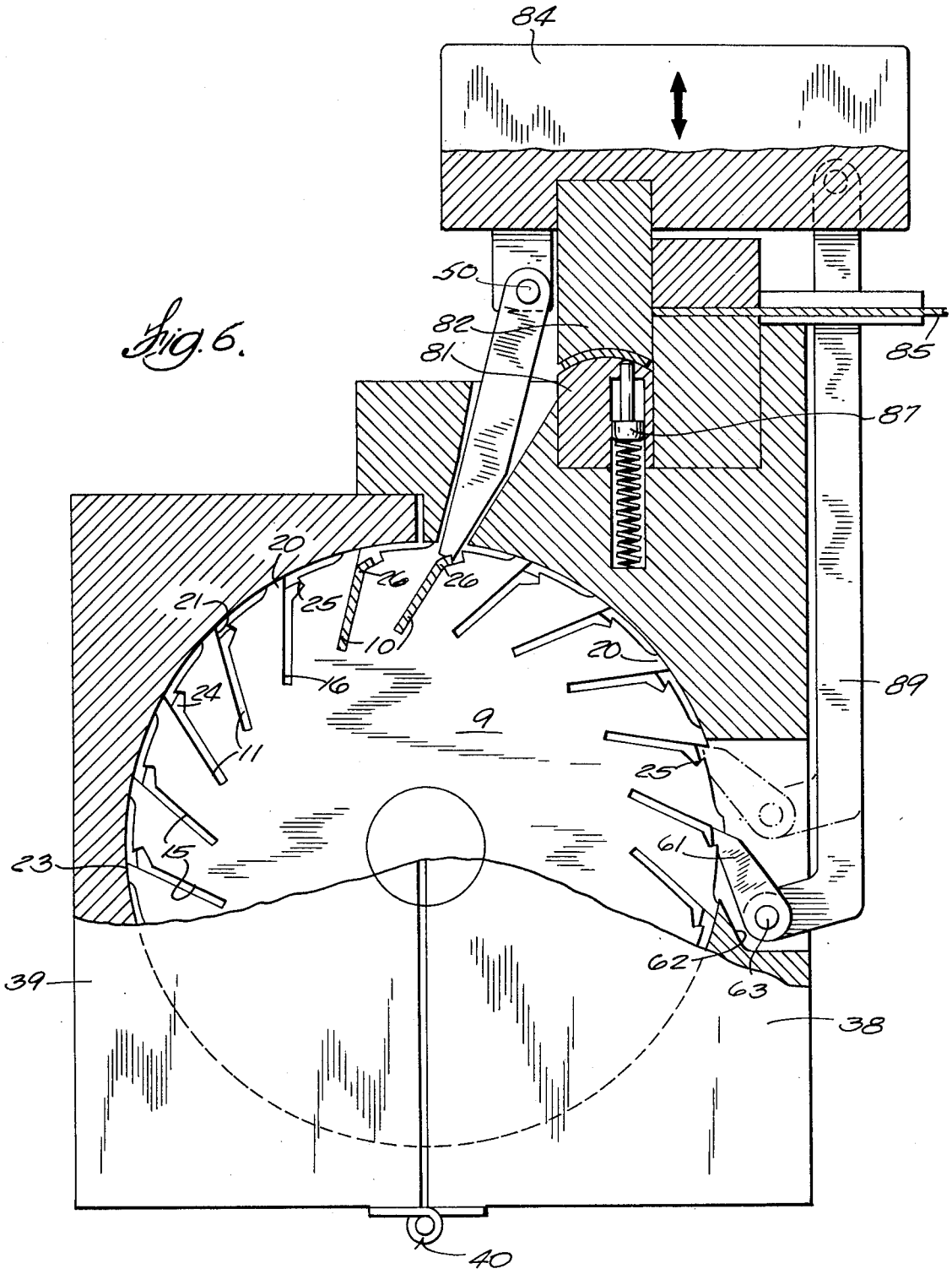
FIG. 6 is a view generally similar to FIG. 5 but illustrating a modified embodiment of the machine.
Figure 8:
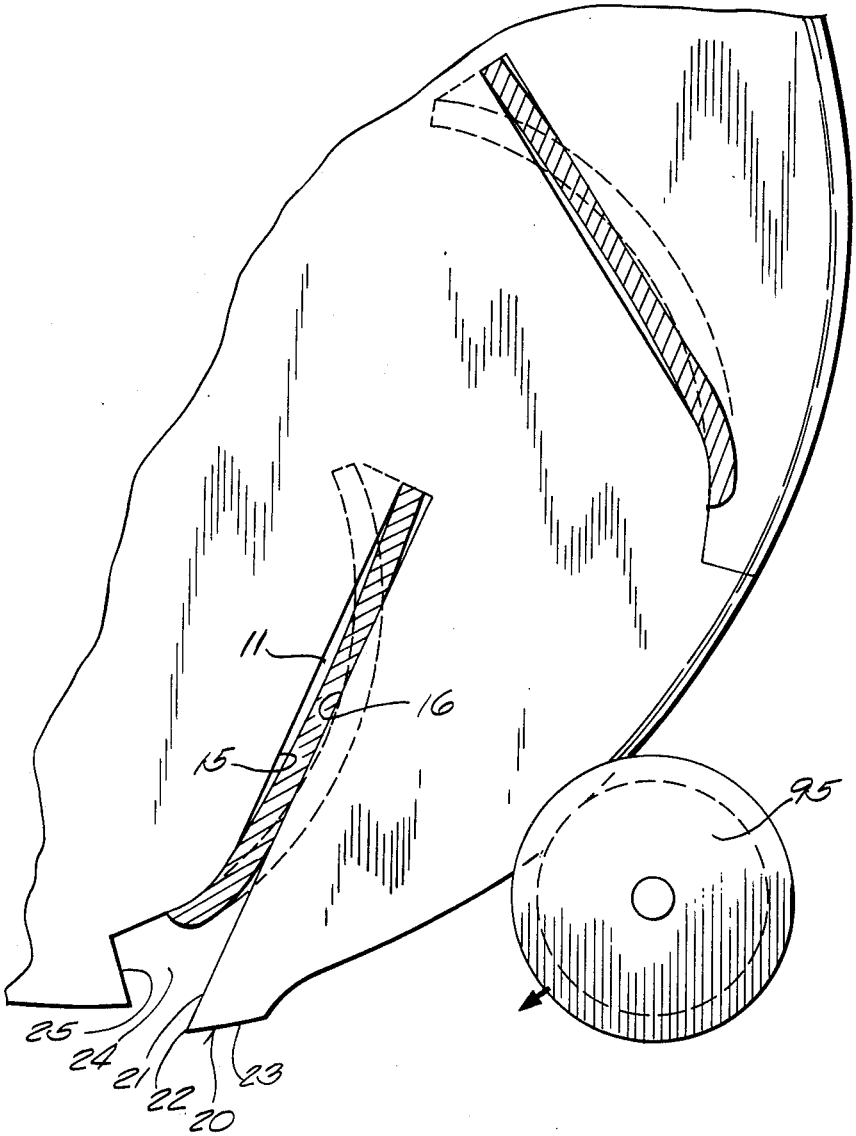
FIG. 8 is a fragmentary view of a position of a rotor disc with blades (shown in section) inserted into its slots in accordance with this invention, and showing how tabs on the disc are edgewise deformed to close the mouths of the slots.

In the modified embodiment of the invention that is illustrated in FIG. 6 blades are formed from flat sheet metal stock substantially simultaneously with assembly of a rotor, each blade being formed just before it is inserted into disc slots. The embodiment of FIG. 6 can have a single actuator which can be in the nature of a hydraulic press mechanism and which can serve for both actuation and synchronization of the blade forming means, the blade inserting pusher and the indexing mechanism.

The fixture 31 in the modified embodiment of the invention is in all respects like that previously described. It can be provided with an actuator for opening and closing it, but none is shown inasmuch as it can be opened and closed manually.

In place of a magazine for finished blades, the machine illustrated in FIG. 6 has, at the top of its stationary fixture member 38 and adjacent to its blade guiding surface 43, a shearing and forming die comprising fixed and movable die members 81 and 82, respectively. The movable die member 82 is carried by the movable member 84 of a hydraulic press for up and down motion with it. Flat sheet metal stock 85 is fed edgewise horizontally into the bite of the die members by a suitable intermittent feed mechanism (not shown) whereby the stock is advanced when the movable die member 82 is in its raised position.

As the press member 84 descends, the die members 81 and 82 cooperate to shear off of the stock 85 a blank of the correct width for a blade, and then, with continued descent of that press member, the die members form the blade to an arcuate cross-section profile and with the crease-like indentations 13 that are described above. As the press member rises towards its fully elevated position, spring loaded ejector pins 87 follow it up and so tilt the newly formed blade that it slides by gravity onto the inclined blade guiding surface 43.

The blade inserting pusher 46 is in this case connected with the movable press member 84 that carries the movable die member 82; hence the pusher 46 is in its elevated or retracted position as the newly formed blade slides down the surface 43, and the blade can therefore pass beneath the pusher. It will be apparent that as the press member 84 descends to form another new blade, the blade inserting pusher 46 is simultaneously driven downwardly in its inserting stroke, so that the blade which is already on the surface 43 is inserted into the discs simultaneously with the formation of a new blade. Synchronization of the blade forming and blade inserting operations is thus inherent.

Inasmuch as the movable press member 84 also actuates the indexing pawls 61, indexing rotation of the discs is likewise properly synchronized with blade insertion by reason of its occurring during upward motion of that press member. The pawls are carried at the lower end of an elongated vertical member 89 that depends from the press member 84 alongside the stationary fixture member 38, or can be mounted on arms like the arm 63' in FIG. 5, with their pivotal connections to the arms adjustable along the length thereof for adjustment of the terminal limit of the indexing stroke of the pawls.

From the foregoing direction taken with the accompanying drawings it will be apparent that this invention provides a simple, inexpensive, sturdy and efficient machine for assembling blower rotors of the character described, which machine can be operated by unskilled labor and can nevertheless attain a high production rate without any sacrifice of accuracy in the assembled rotors produced with it.

Those skilled in the art will appreciate that the invention can be embodied in forms other than as herein disclosed for purposes of illustration.

I claim:

1. The method of assembling a blower rotor that comprises a sheet metal disc and a plurality of elongated blades which extend lengthwise parallel to the disc axis and which are secured to the disc at locations uniformly spaced around its circumference, which method comprises:

A. forming the disc
   1. with a plurality of slots, one for each blade, each said slot opening to the periphery of the disc and being of a shape and size to have a blade inserted edgewise thereinto and of such radial depth that with the blade fully received therein the disc has peripheral portions which are at a greater distance from its axis than the radially outer edge of the blade, and
   2. with a plurality of substantially circumferentially facing edge portions, one for each slot, said edge portions extending to the disc periphery and being spaced at equal circumferential distances from one another;

B. so confining the disc, by engaging only its said peripheral portions at circumferentially spaced zones, as to constrain the disc to rotation about its axis;

C. by engaging successive ones of said circumferentially facing edge portions and applying to each a force in the opposite circumferential direction effecting rotational indexing movements of the disc, each of which brings a different one of said slots to a blade inserting station;

D. each time a new slot is brought to said blade inserting station, effecting guided edgewise movement of a blade all the way into said slot; and E. making a permanent connection between each inserted blade and the disc whereby the blade is confined against displacement out of its slot.

2. The method of claim 1 wherein said peripheral portions of the disc comprises tab-like radial projections thereon, each adjacent to the mouth of one of said slots, and wherein each of said circumferentially facing edge portions is on one of said tab-like projections and is substantially continuous with an edge of its adjacent slot, further characterized by:

F. after each slot has had a blade inserted into it, making said permanent connection by edgewise deforming the tab-like projection adjacent to the slot to displace it into the mouth of the slot and thus confine the blade against displacement relative to the disc.

3. The method of assembling a blower rotor from at least one disc having slots therein at uniform circumferentially spaced intervals, which slots open to the periphery of the disc and thus provide edge surfaces on the disc that extend to its periphery and face in one circumferential direction, and a plurality of elongated blades, one receivable in each slot, to extend lengthwise parallel to the disc axis with the disc engaging the blade at a predetermined location along its length, said method being characterized by:

A. so forming the blades and the slots that when each blade is fully received in its slot, peripheral portions of the disc that comprise said edge surfaces will be at a greater distance from the disc axis than the radially outer edges of the blades;

B. confining the disc to rotation by engaging only said peripheral portions thereof at circumferentially spaced zones around the disc;

C. effecting rotational indexing movements of the disc, each of which brings a different one of said slots to a blade inserting station, by
   1. moving an indexing driver between defined limits first in the opposite circumferential direction relative to the disc and then in said one circumferential direction, and 2. meanwhile maintaining a yielding biasing force upon said indexing driver in a direction parallel to the plane of the disc and radially inwardly thereof so that the indexing driver can be engaged with one of said edge surfaces while moving in said opposite circumferential direction but is ineffective to impart rotation to the disc while moving in said one circumferential direction;

D. at the blade inserting station guiding each blade for translatory motion transversely to its length and in a direction parallel to the plane of the disc, with said location on the blade lying in the plane of the disc;

E. as each new slot in the disc is brought to said station, inserting a blade thereinto by such translatory motion of the blade; and F. making a permanent connection between each inserted blade and the disc whereby the blade is confined against displacement out of its slot.

4. The method of claim 3, further characterized in that said permanent connection is made by:

rolling the periphery of the disc under edgewise compressive force to restrict the mouth of each slot and thus confine the blade therein against edgewise displacement relative to the disc.

* * * * *